US005492380A

United States Patent [19]

Smallegan et al.

[11] Patent Number: 5,492,380

[45] Date of Patent: Feb. 20, 1996

[54] DOOR LATCH OPERATING ASSEMBLY

[75] Inventors: Jon M. Smallegan; L. C. Derek Chamberlain; Dario Pompeii, all of Colorado Springs, Colo.

[73] Assignee: Schlage Lock Company, San Francisco, Calif.

[21] Appl. No.: 364,645

[22] Filed: Dec. 27, 1994

[51] Int. Cl.[6] ..... E05B 3/00

[52] U.S. Cl. ..... 292/336.3; 292/140; 292/244

[58] Field of Search ..... 292/140, 143, 292/244, 336.3, 145, 165, 170

[56] References Cited

U.S. PATENT DOCUMENTS

| | | | |
|---|---|---|---|
| 1,810,350 | 6/1931 | Hines | 292/336.3 |
| 3,257,138 | 6/1966 | Russell et al. | 292/336.3 |
| 3,287,054 | 11/1966 | Russell et al. . | |
| 3,990,277 | 11/1976 | Mullich . | |
| 3,999,789 | 12/1976 | Maurits et al. . | |
| 4,145,900 | 3/1979 | Ohno . | |
| 4,156,541 | 5/1979 | Babb, Jr. et al. . | |
| 4,183,563 | 1/1980 | Stevens . | |
| 4,276,760 | 7/1981 | Nolin . | |
| 4,838,053 | 6/1989 | Shen . | |
| 4,979,767 | 12/1990 | Lin . | |
| 4,982,986 | 1/1991 | Gressett, Jr. et al. | 292/244 |

*Primary Examiner*—Rodney M. Lindsey

*Attorney, Agent, or Firm*—Keith F. Noe; Robert F. Palermo

[57] ABSTRACT

A door latch operating assembly is capable of rotating a door latch arm between a first locked position for locking a door in a closed position and a second unlocked position for unlocking the door. The latch operating assembly includes a lock platform and a handle having a gripper portion which is grasped by a person's hand for rotating the handle, and a shaft portion attached to the gripper portion and extending therefrom through an opening in the lock platform. A driver cam has a housing which receives the shaft portion of the handle, and at least one wing member extending laterally outwardly from one side of the housing. The wing member has an upwardly facing engaging surface for engaging a link which is linearly movable with respect to the lock platform. The link has a bottom edge portion with a downwardly facing engaging surface which bears against the upwardly facing engaging surface of the wing member of the driver cam, and a top edge portion with an upwardly facing engaging surface. A disk is rotatably mounted on the face plate of the lock platform about an axis of rotation and has a detent radially spaced from the axis of rotation which is engageable with the upwardly facing engaging surface of the top edge portion of the link. The link rotates the disk upon movement of the link. A shaft is mounted on the disk and rotatable about the axis of rotation, the shaft carrying the latch arm thereon whereby the latch arm is moved between its first and second positions.

7 Claims, 4 Drawing Sheets

DOOR LATCH OPERATING ASSEMBLY

BACKGROUND OF THE INVENTION

This invention generally relates to door hardware and more particularly to a door latch operating assembly which reduces the angle of rotation of a door handle.

Upon passage of the recent federal disabilities act, efforts have been made to make access through doors easier for persons having disabilities. One area of focus has been to reduce the angle of rotation of a door handle required to open the door. Many prior art latch operation mechanisms require the person opening the door to rotate the handle nearly ninety degrees. The present invention is directed to an improved door latch operating assembly which is capable of rotating a door latch arm of a latching assembly between a position in which the door latch arm causes a bolt member to extend into an opening formed in a door jamb to a position in which the door latch arm causes the bolt member to retract out of the opening of the door jamb and into the door. The improved door latch operating assembly reduces the angle of rotation of the door handle when opening the door.

The foregoing illustrates limitations known to exist in present door latch operating assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door latch operating assembly capable of rotating a door latch arm between a first locked position for locking a door in a closed position and a second unlocked position for unlocking the door. The latch operating assembly comprises a lock platform having a face plate and an outer peripheral edge margin extending generally perpendicularly away from the face plate towards the door. The face plate extends along a vertical plane generally parallel with respect to the vertical plane of the door and has an opening formed therein. A handle has a gripper portion adapted to be grasped by a person's hand for rotating the handle, and a shaft portion attached to the gripper portion and extending therefrom through the opening of the lock platform. A driver cam has a housing with a bore formed therein shaped for receiving the shaft portion of the handle therethrough so that the driver cam rotates when rotating the handle, and at least one wing member extending laterally outwardly from one side of the housing. The wing member has an upwardly facing engaging surface for engaging a link which is linearly movable with respect to the lock platform. The link has a bottom edge portion with a downwardly facing engaging surface which bears against the upwardly facing engaging surface of the wing member of the driver cam, and a top edge portion with an upwardly facing engaging surface. The wing member of the driver cam is adapted to move the link upwardly when rotating the driver cam. A disk is rotatably mounted on the face plate of the lock platform about an axis of rotation and has a detent radially spaced from the axis of rotation which is engageable with the upwardly facing engaging surface of the top edge portion of the link. The link is adapted to rotate the disk upon movement of the link, the amount of rotation of the disk being controlled by the location of the detent thereon wherein the further the detent is spaced from the axis of rotation the less the disk rotates when the link is moved and closer the detent is spaced towards the axis of rotation the more the disk rotates when the link is moved. A shaft is mounted on the disk and rotatable about the axis of rotation, the shaft carrying the latch arm thereon whereby the latch arm is moved between its first and second positions.

Accordingly, among the several objects of the present invention are the provision of an improved door latch operating assembly which reduces the angle of rotation required to rotate a door handle; the provision of such a door latch operating assembly which may be assembled to accommodate left-hand or right-hand use; and the provision of such a door latch operating assembly which is simple in design and easy to assemble.

The foregoing and other aspects will become apparent from the following detailed description of the invention when considered in conjunction with the accompanying drawing figures.

BRIEF DESCRIPTION OF THE DRAWING FIGURES

In the drawings which illustrate the best mode presently contemplated for carrying out the present invention:

Corresponding reference numerals designate corresponding parts throughout the several views of the drawings.

DETAILED DESCRIPTION

Figure 1:
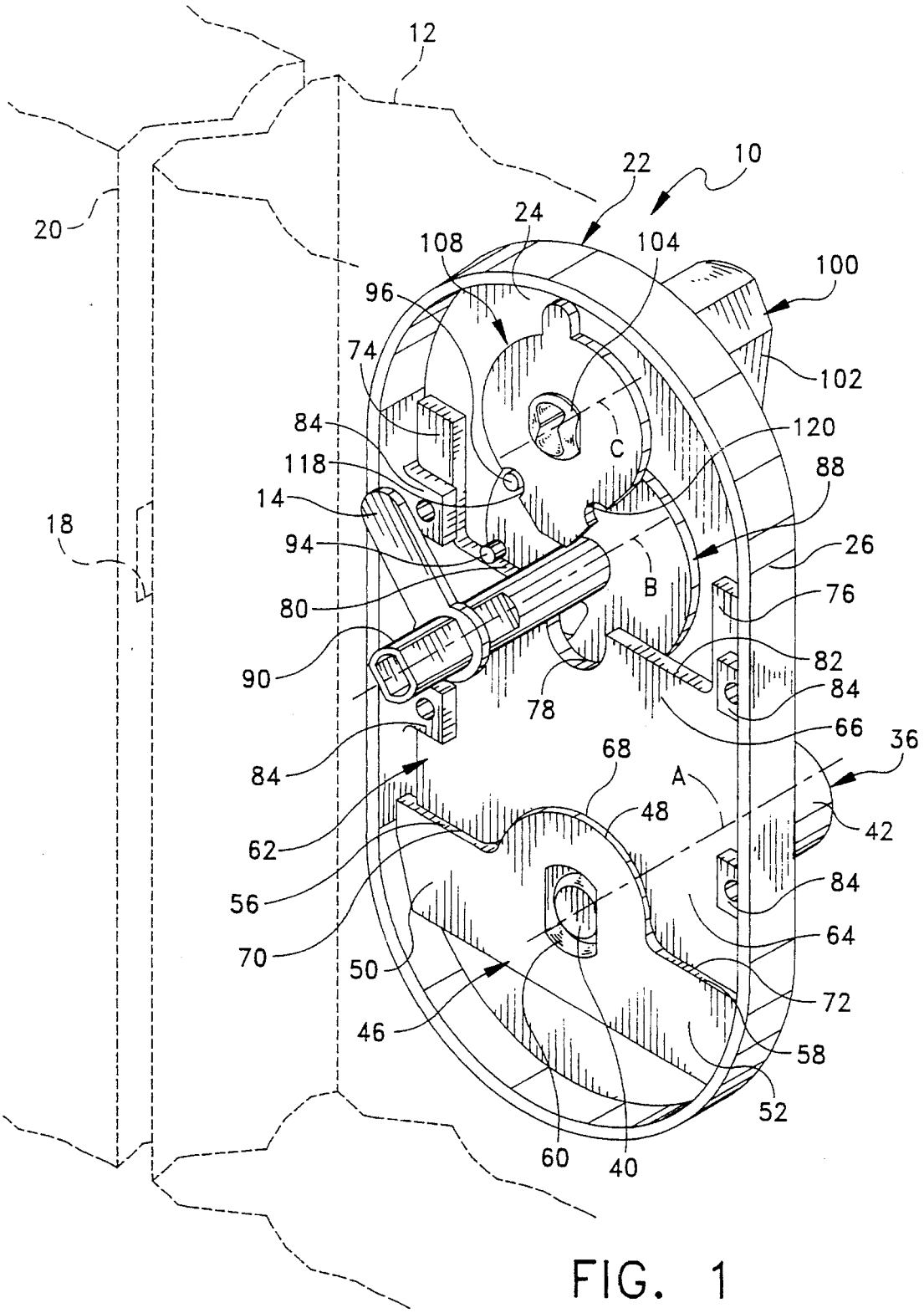
FIG. 1 is a rear perspective view of a door latch operating assembly of the present invention.

Referring now to the drawings, wherein similar reference characters designate corresponding parts throughout the several views, the embodiment of the assembly shown in FIG. 1 comprises a door latch operating assembly 10 for a door 12 of conventional construction according to one embodiment of the invention. The door latch operating assembly 10 of the present invention is especially suited for rotating a door latch arm 14 between a first locked position and a second open position. More particularly, the door latch arm actuates a bolt member (e.g., a spring latch 16 illustrated in broken lines in FIGS. 3 and 4) to extend into an opening 18 formed in a door jamb 20 for locking the door 12 in a closed position. In the second position, the door latch arm 14 rotates to retract the bolt member 16 out of the opening 18 of the door jamb 20 and into the door 12 for unlocking the door wherein the door can be opened or closed in conventional fashion. The assembly 10 of the present invention is directed to moving the latch arm 14 between its first and second positions and not to the construction and operation of the spring latch.

Assembly 10 comprises a lock platform, generally indicated at 22, a oval face plate 24 lying in a vertical plane parallel to the plane of door 12 and an outer peripheral edge margin 26 which extends from the outer periphery of the face plate 24 generally perpendicularly away from the face plate 24 and towards the door 12 when mounting the lock platform 22 on the door 12. The edge margin 26 of the lock platform 22 engages the door 12 in such a manner that the face plate 24 is spaced from the door 12 thereby creating a space between the face plate 24 and the door 12. As illustrated best in FIG. 2, the lock platform 22 includes an outwardly facing, circular-shaped first hollow boss 28 defining a first opening 30, and an inwardly facing, circular-shaped second hollow boss 32 defining a second opening 34, the second hollow boss 32 and opening 34 being located above the first hollow boss 28 and opening 30. As illustrated throughout the drawings, the first and second hollow bosses 28, 32 are integral with the face plate 24, the first hollow boss 28 extending from the face plate 24 in a direction opposite to the direction of the second hollow boss 32. Preferably the lock platform 22, along with the other components of the mounting assembly 10, is fabricated from rigid metal, such as steel or brass. It should be understood that the face plate 24 may embody any number of shapes (e.g., rectangular, circular, etc.) and not just the oval shape illustrated in the drawings.

Latch operating assembly 10 further comprises a handle, generally indicated at 36, having a gripper portion 38 and a shaft portion 40 attached at one of its ends to the gripper portion 38. More specifically, the gripper portion 38 includes a cylindrical member 42 which is integrally attached to the shaft portion 40 and a lever 44 which extends outwardly from one side of the member 42, the lever 44 being designed to be grasped by a person's hand for turning the handle 36. Although the lever 44 is illustrated in the drawings, it should be understood that any member suitable for being grasped by a person's hand, such as a knob, for example, may be substituted for the lever 44. As illustrated throughout the drawings, the shaft portion 40 is received within the first opening 30 of the face plate 24 with the gripper portion 38 being positioned outboard with respect to the lock platform 22 when assembling the mounting assembly 10.

Figure 2:
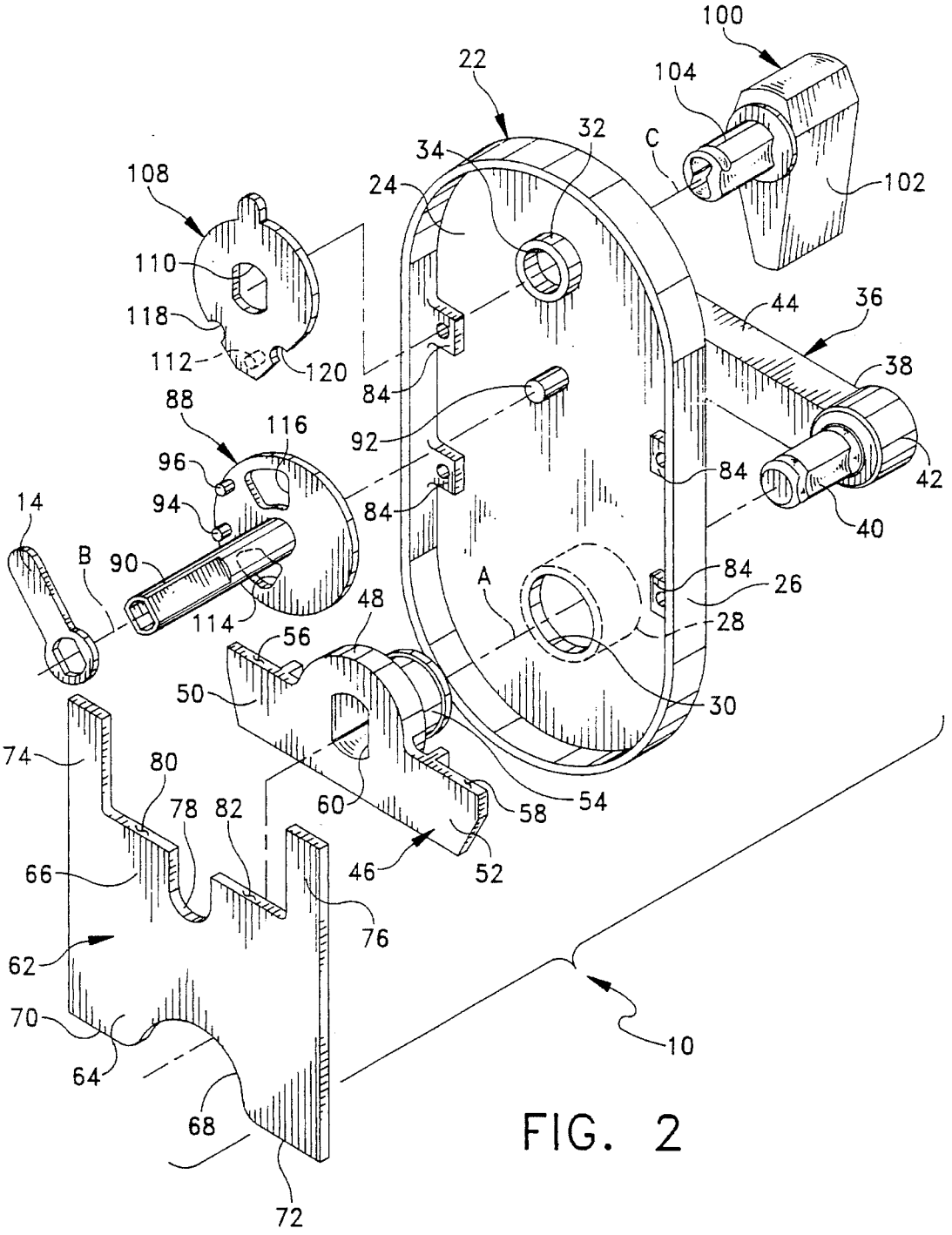
FIG. 2 is an exploded perspective view of the door latch operating assembly illustrated in FIG. 1.

Generally indicated at 46 is a driver cam having an annular housing 48 with two oppositely extending wing members 50, 52 which extend laterally outwardly from opposite sides of the housing 48, and a hollow boss 54 which is adapted to extend from the annular housing 48 through the first opening 30 of the lock platform as illustrated in FIG. 2. The wing members 50, 52 include first and second upwardly facing engaging surfaces 56, 58, respectively. The purpose of the engaging surfaces 56, 58 will become apparent as the description of assembly 10 proceeds.

The annular housing 48 and hollow boss 54 of the driver cam 46 are concentrically aligned along a longitudinal axis A to form a continuous bore 60 which receives the shaft portion 40 of the handle 36 therein for rotating the driver cam 46 when the handle 36 is rotated. The bore 60 of the annular housing 48 and hollow boss 54 is shaped for receiving the shaft portion 40 of the handle 36 therein so that the driver cam 46 rotates when rotating the handle 36. Preferably, there is a slight clearance fit between the hollow boss 54 of the driver cam 46 and the shaft portion 40 of the handle 36 so that the shaft portion 40 may easily be inserted into the hollow boss 54 and is capable of rotating the driver cam 46.

The lock platform 22, handle 36 and driver cam 46 are interconnected with one another in such a manner that any axial movement between these components is prohibited. Reference should be made to co-pending, related application entitled Door Handle Mounting Assembly, of the Ingersoll-Rand Company, for the specific construction and assembly of these components.

Figure 3:
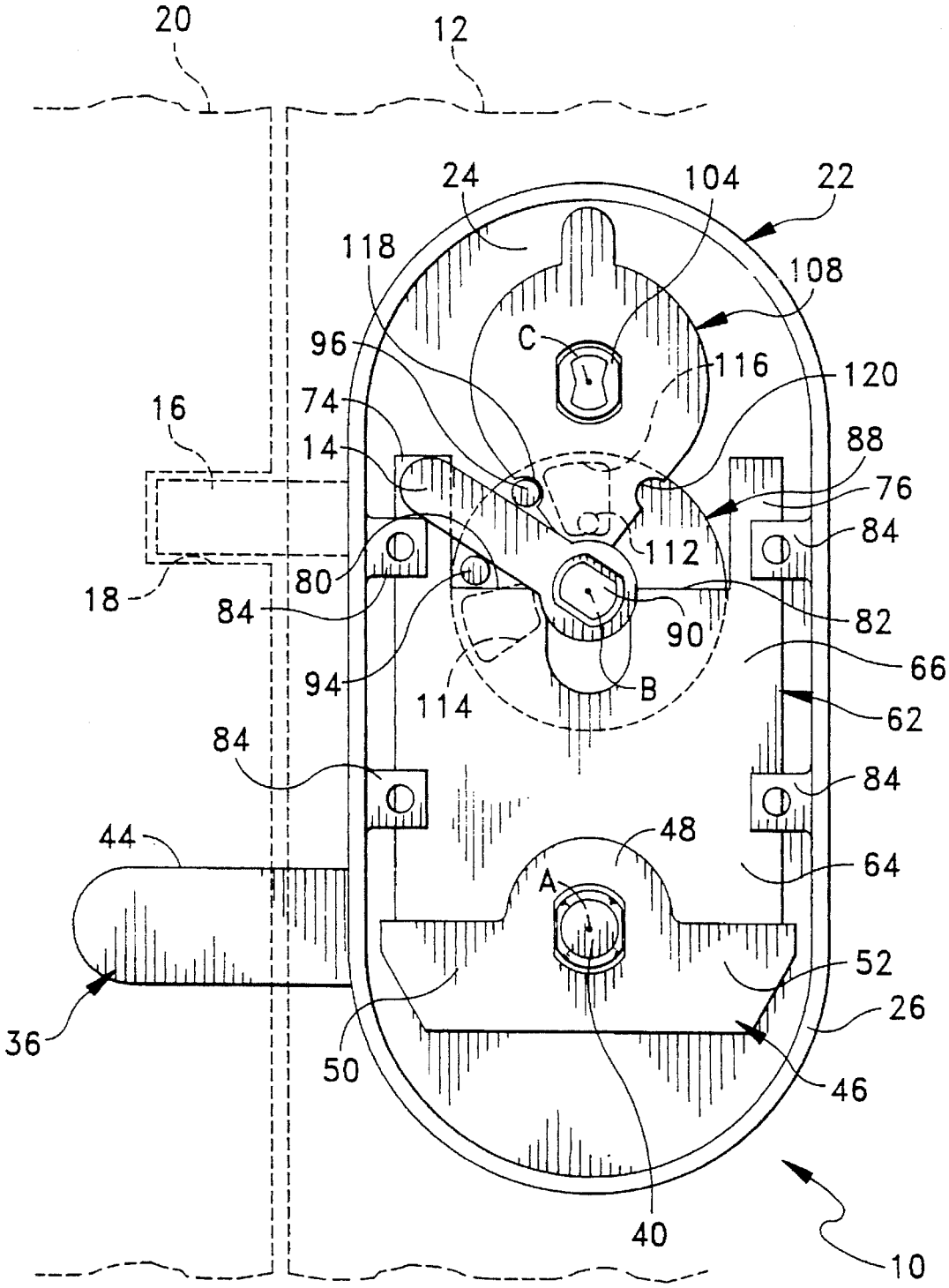
FIG. 3 is a rear elevational view of the door latch operating assembly, a latch arm of the assembly being illustrated in a locked position.
Figure 4:
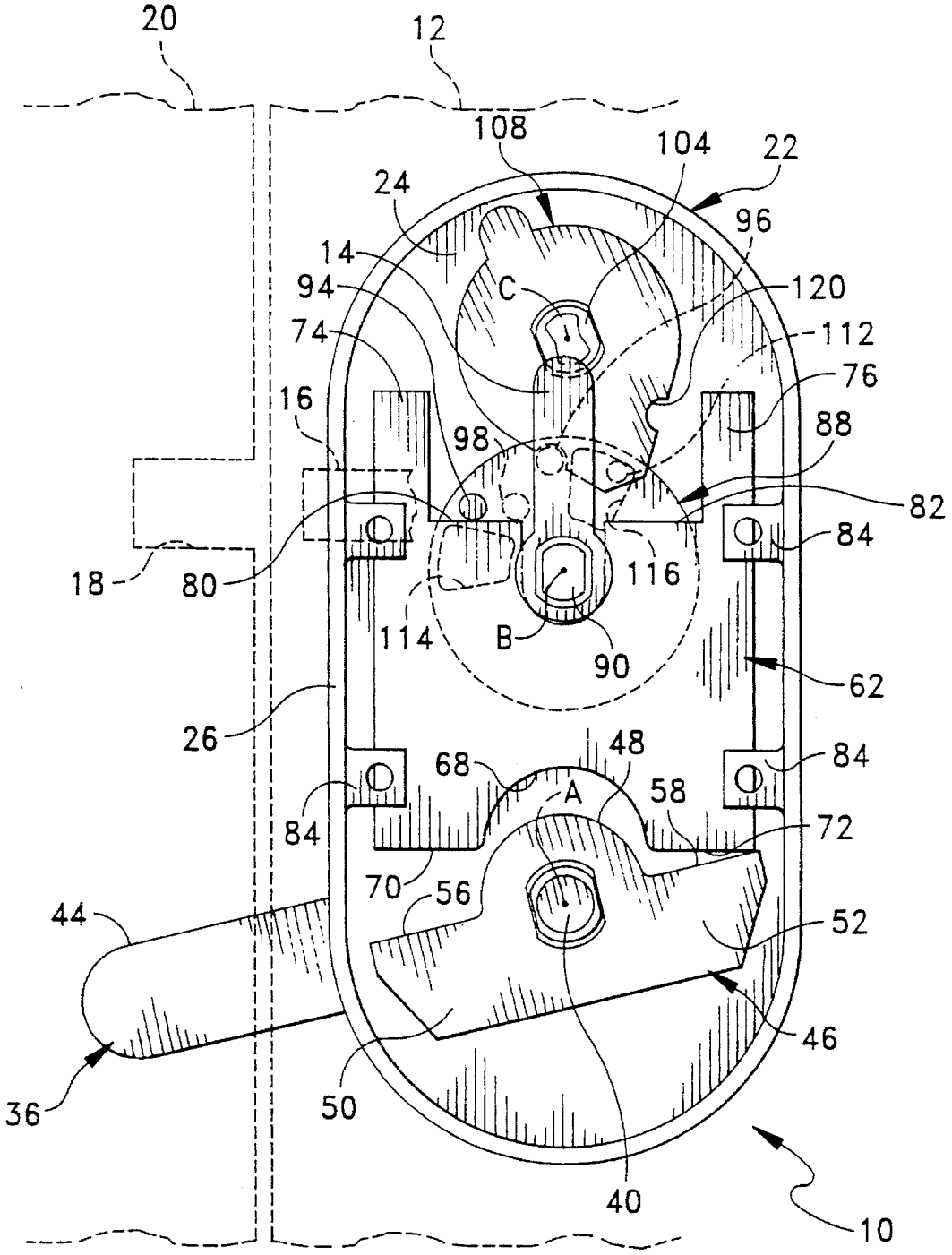
FIG. 4 is a rear elevational view of the door latch operating assembly, the latch arm of the assembly being illustrated in an unlocked position.

Assembly 10 further comprises an H-shaped link, generally indicated at 62, having a bottom edge portion 64 and a top edge portion 66. The bottom edge portion 64 includes a semi-circularly-shaped recess 68 which receives therein the annular housing 48 of the driver cam 46 and two downwardly facing first and second engaging surfaces 70, 72 which bear against respective upwardly facing engaging surfaces 56, 58 of the wing members 50, 52 when the driver cam 46 is in its neutral (un-rotated) position as illustrated in FIGS. 1 and 3. The top edge portion 66 includes two upwardly extending arms 74, 76, a U-shaped recess 78 and two upwardly facing first and second engaging surfaces 80, 82. As best illustrated in FIG. 4, the wing members 50, 52 of the driver cam 46 move the link 62 linearly upwardly when rotating the driver cam 46. More specifically, when the handle 36 is rotated in a clockwise direction, the second engaging surface 58 of the second wing member 52 engages the second downwardly facing engaging surface 72 of the link 62 for moving the link 62 linearly upwardly (see FIG. 4). Similarly, when the handle 36 is rotated in a counterclockwise direction, the first engaging surface 56 of the first wing member 50 engages the first downwardly facing engaging surface 70 of the link 62 for moving the link 62 linearly upwardly with respect to the lock platform 22 in an identical fashion as when the handle 36 is rotated clockwise. In any event, the link 62 moves linearly upwardly upon rotating the handle 36 clockwise or counterclockwise.

Four guide members, each indicated at 84, define a track which receives the link 62 therein for guiding its linear up-and-down movement. Each guide member 84 is attached to and extends inwardly from the peripheral edge margin 26 of the lock platform 22 along a plane generally parallel to the plane of the face plate 24 as illustrated in FIG. 2. The link 62 is adapted to move linearly downwardly due to its own weight when the driver cam 46 assumes a neutral position in which the wing members 50, 52 are horizontal. In another embodiment (not shown), a spring can move the link 62 downwardly when the driver cam 46 is rotated back to its neutral position. It should be noted that the driver cam 46 and link 62 occupy the narrow space between the face plate 24 of the lock platform 22 and the door 12 and thereby are narrow in cross section.

The assembly 10 also comprises a disk, generally indicated at 88, rotatably mounted on the inner surface of the face plate 24 of the lock platform 22 about an axis of rotation B. More specifically, the disk 88 is formed with a hollow shaft 90 which is integrally formed with the disk 88 and rotatable about axis B. The shaft 90 is positioned on the disk 88 to extend through a 2⅛ inch diameter bored hole (not shown) formed in the door 12, the bored hole being standard on most commercial and retail doors. The face plate 24 further includes an inwardly facing pin or dowel 92 which is inserted into a cavity formed by the hollow shaft 90 and disk 88 which enables the disk and shaft to rotate about axis B. The recess 78 formed in the top edge portion 66 of the link 62 receives the shaft 90 when the link is raised. First and second detents 94, 96 are mounted on the disk 88 and extend inwardly from the disk 88. The detents 94, 96 are positioned so that each detent is spaced from the axis of rotation B and is engageable with one of the upwardly facing engaging surfaces 80, 82 of the top edge portion 66 of the link 62 depending upon the handing of the assembly. The arrangement is such that the first detent 94 can be positioned to engage the first upwardly engaging surface 80 of the link 62 (illustrated throughout the drawings) and the second detent 96 can be positioned to engage the second upwardly engaging surface 82 of the link 62 (not illustrated). Thus, in the shown embodiment, when rotating the handle 36 in either a clockwise or counterclockwise direction (and thereby rotating the driver cam 46 which moves the link 62 linearly upwardly), the link 62 rotates the disk 88 clockwise as viewed in FIGS. 3 and 4 whereby the first detent 94 engages the first upwardly engaging surface 80 of the link 62. However, it should be understood that the arrangement may be such that the second detent 96 engages the second upwardly engaging surface 82 when it is desired to reverse the handing of the assembly 10. The shaft 90 receives the latch arm 14 thereon wherein FIGS. 1 and 3 illustrate the latch arm 14 in its first position and FIG. 4 illustrates the latch arm 14 in its second position which results from rotating the handle 36 and moving the link 62 upwardly.

As mentioned above, the assembly 10 of the present invention is directed towards reducing the angle of rotation required to rotate the handle 36 which in turn rotates the latch arm 14 between its first and second positions. The amount of rotation of the disk 88 is controlled by the location of the detents 94, 96 thereon. For example, the further the detents 94, 96 are spaced from the axis of rotation B, the less the disk 88 rotates when the link 62 is moved. Conversely, the closer the detents 94, 96 are spaced towards the axis of rotation B, the more the disk 88 rotates when the link 62 is moved. FIG. 4 shows a detent 98 in broken lines which is positioned proximate to the axis of rotation B. As illustrated, this detent 98 is rotated at a greater angle with respect to the detent 94 shown in solid lines. Thus, by locating the detents closer to the axis of rotation, the angle of rotation of the handle 36 required to move the latch arm 14 between its first and second positions is reduced. It has been discovered that the assembly 10 of the present invention is capable of moving the latch arm 14 between its first and second positions by rotating the handle approximately thirty degrees.

The assembly 10 is further provided with a thumb turn member generally indicated at 100 having a thumb turn gripper portion 102 adapted to be grasped by a person's hand for rotating the thumb turn member 100, and a thumb turn shaft portion 104 attached to the thumb turn gripper portion 102 and extending therefrom through the second opening 34 of the lock platform 22. The thumb turn member 100 is also capable of moving the latch arm 14 between its first and second positions. As shown, the thumb turn shaft portion 104 rotates about axis C. Specifically, a thumb turn arm, generally indicated at 108, has an opening 110 formed therein shaped for receiving the thumb turn shaft portion 104 therethrough in such a manner that the thumb turn arm 108 rotates when rotating the thumb turn member 100. The thumb turn arm 108 is selectively engageable with the disk 88 for rotating the disk when the thumb turn member 100 is rotated. The thumb turn arm 108 has an outwardly projecting protrusion 112 which is received through one of two openings 114, 116 formed in the disk 88 for engaging the disk 88 as illustrated in the drawings. The arrangement is such that, when rotating the thumb turn member 100 counterclockwise, the protrusion 112 of the thumb turn arm 108 selectively engages the disk 88 for rotating the disk 88 clockwise as illustrated in the drawings and thereby rotating the latch arm 14 between its first and second positions. The second opening 116 is provided for when the second detent 96 is engaging the second upwardly engaging surface 82 of the link 62. The thumb turn arm 108 is axially movable by appropriate means for selectively positioning the protrusion 112 within the opening 114 so that the protrusion 112 engages the disk 88.

In a preferred embodiment, the second detent 96 of the disk 88 is received in the first of two notches 118, 120 formed along opposite sides of the thumb turn arm 108. It should be understood that when the second detent 96 is engaging the second upwardly engaging surface 82 of the link 62, the first detent 94 is received within the second notch 120. The arrangement is such that upon movement of the link 62 upwardly, the second detent 96 rotates the thumb turn arm 108 which in turn rotates the thumb turn member 100 if it is not in a locked condition (i.e., incapable of rotating). If the thumb turn member 100 is locked, the thumb turn arm 108 prohibits the rotation of the disk 88 and thus the movement of the link 62 and rotation of the driver cam 46 and handle 36, thereby preventing the movement of the latch arm 14 from its first position to its second position. This arrangement is necessary to maintain the door 12 in a locked condition.

It should be observed that the door latch operating assembly 10 of the present invention is capable of rotating the door latch arm 14 between its first position (for locking the door 12 in a closed position) and its second rotated position (for unlocking the door 12) when rotating the handle 36 a reduced angle of rotation (e.g., thirty degrees). As illustrated throughout the drawings, the components of the assembly 10 are capable of being assembled on the door 12 for left- or right-hand operation. In use, upon rotation of the handle 36 in either a clockwise or counterclockwise direction, the driver cam 46 rotates to move the H-shaped link 62 upwardly. More specifically, when the handle 36 is rotated in the clockwise direction, the second engaging surface 58 of the second wing member 52 engages the second downwardly facing engaging surface 72 of the link 62 for moving the link 62 linearly upwardly (see FIG. 4). When the handle 36 is rotated in a counterclockwise direction, the first engaging surface 56 of the first wing member 50 engages the first downwardly facing engaging surface 70 of the link 62 for moving the link 62 linearly upwardly. Depending upon the handing of the assembly 10, the first upwardly engaging surface 80 of the link 62 engages the first detent 94 of the disk 88 or the second upwardly engaging surface 82 of the link 62 engages the second detent 96 of the disk 88 for rotating the disk 88 and the latch arm 14 from its first position (locked) to its second position (unlocked). This result can also be accomplished by turning the thumb turn member 100 counterclockwise when the assembly is arranged as illustrated in the drawings.

While this invention has been illustrated and described in accordance with a preferred embodiment, it is recognized that variations and changes may be made therein without departing from the invention as set forth in the following claims.

Having described the invention, what is claimed is:

1. A door latch operating assembly capable of rotating a door latch arm between a first locked position for locking a door in a closed position and a second unlocked position for unlocking said door, said latch operating assembly comprising:

a lock platform having a face plate and an outer peripheral edge margin extending generally perpendicularly away from the face plate towards the door, the face plate extending along a vertical plane generally parallel with respect to the vertical plane of the door and having an opening formed therein;

a handle having a gripper portion adapted to be grasped by a person's hand for rotating the handle, and a shaft portion attached to the gripper portion and extending therefrom through said opening of the lock platform;

a driver cam having a housing with a bore formed therein shaped for receiving the shaft portion of the handle therethrough so that the driver cam rotates when rotating the handle, and at least one wing member extending laterally outwardly from one side of the housing, said wing member having an upwardly facing engaging surface;

a link linearly movable with respect to said lock platform, said link having a bottom edge portion with a downwardly facing engaging surface which bears against the upwardly facing engaging surface of the wing member of the driver cam, and a top edge portion with an upwardly facing engaging surface, said wing member of said driver cam being adapted to move the link when rotating said driver cam;

a disk rotatably mounted on the face plate of the lock platform about an axis of rotation, said disk having a detent radially spaced from said axis of rotation and engageable with the upwardly facing engaging surface of the top edge portion of the link, said link being adapted to rotate said disk upon movement of the link, the amount of rotation of the disk being controlled by the location of the detent thereon wherein the further the detent is spaced from said axis of rotation the less the disk rotates when the link is moved and closer the detent is spaced towards said axis of rotation the more the disk rotates when the link is moved; and a shaft mounted on said disk and rotatable about said axis of rotation, said shaft carrying said latch arm thereon whereby said latch arm is moved between its first and second positions.

2. The assembly as set forth in claim 1, said driver cam having a second wing member extending laterally outwardly from the housing in a direction opposite to the first wing member, said second wing member having a second upwardly facing engaging surface, said link having a second downwardly facing engaging surface which bears against the second upwardly facing engaging surface of the wing member of the driver cam whereby upon rotation of the driver cam in either a clockwise or counterclockwise direction, said wing members of said driver cam being adapted to move the link for rotating said latch arm between its first and second positions when said driver cam is rotated.

3. An assembly as set forth in claim 1, said face plate of the lock platform having a second opening formed therein above the first opening.

4. An assembly as set forth in claim 3 further comprising a thumb turn member having a thumb turn gripper portion adapted to be grasped by a person's hand for rotating the thumb turn member, and a thumb turn shaft portion attached to the thumb turn gripper portion and extending therefrom through said second opening of the lock platform, and a thumb turn arm having an opening formed therein, said thumb turn arm being received over the thumb turn shaft portion and engageable with said disk for rotating said disk when the thumb turn member is rotated.

5. An assembly as set forth in claim 4, said thumb turn arm having an inwardly projecting protrusion, and said disk having an opening formed therein, said protrusion projecting through the opening in the disk for engaging the disk, the arrangement being such that, when rotating the thumb turn member, said protrusion of said thumb turn arm engages said disk for rotating said disk and thereby rotating said latch arm between its first and second positions.

6. An assembly as set forth in claim 4, said disk having a second detent spaced above the first detent, and said thumb turn arm having a notch formed therein, said second detent being received in the notch of the thumb turn arm wherein, upon movement of the link upwardly, the second detent rotates the thumb turn arm.

7. An assembly as set forth in claim 1, said lock platform having a plurality of guide members attached to and extending inwardly from said peripheral edge margin along a plane generally parallel to the plane of said face plate, said guide members and face plate defining a track which receives the link therein for guiding its up-and-down movement.

* * * * *